US011132938B2

(12) United States Patent
Nam

(10) Patent No.: US 11,132,938 B2
(45) Date of Patent: Sep. 28, 2021

(54) DISPLAY DEVICE AND DRIVING METHOD THEREOF

(71) Applicant: Samsung Display Co., Ltd., Yongin-Si (KR)

(72) Inventor: Yang Uk Nam, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/817,475

(22) Filed: Mar. 12, 2020

(65) Prior Publication Data

US 2021/0043132 A1 Feb. 11, 2021

(30) Foreign Application Priority Data

Aug. 6, 2019 (KR) ..... 10-2019-0095700

(51) Int. Cl.
*G09G 3/32* (2016.01)

(52) U.S. Cl.
CPC ..... *G09G 3/32* (2013.01); *G09G 2300/0819* (2013.01); *G09G 2320/0247* (2013.01); *G09G 2330/023* (2013.01)

(58) Field of Classification Search
CPC ..... G09G 3/32; G09G 2300/0819; G09G 2320/0247; G09G 2330/023
See application file for complete search history.

(56) References Cited

U.S. PATENT DOCUMENTS

2011/0157141 A1* 6/2011 Woo ..... H02M 3/156 345/212
2021/0043821 A1* 2/2021 Hussell ..... G09G 3/2096

FOREIGN PATENT DOCUMENTS

KR 10-1952939 B1 2/2019

* cited by examiner

*Primary Examiner* — Robert J Michaud
(74) *Attorney, Agent, or Firm* — Innovation Counsel LLP

(57) ABSTRACT

A display device includes: pixels; and a power converter for receiving a first voltage, converting the first voltage to a second voltage, and providing an output terminal with the second voltage to control the pixels. The power converter includes: a first variable load connected to the output terminal of the power converter; a first comparator for providing a comparison result by comparing a difference between a first feedback voltage of the first voltage and a second feedback voltage of the second voltage; and a gap controller for controlling a magnitude of the first variable load to maintain the difference between the first voltage and the second voltage to be greater than or equal to a gap, based on the comparison result received from the first comparator.

20 Claims, 11 Drawing Sheets

DISPLAY DEVICE AND DRIVING METHOD THEREOF

CROSS-REFERENCE TO RELATED APPLICATION

The present application claims priority under 35 U.S.C. § 119(a) to Korean patent application 10-2019-0095700 filed on Aug. 6, 2019 in the Korean Intellectual Property Office, the disclosure of which is incorporated herein by reference in its entirety.

BACKGROUND

1. Technical Field

The present disclosure generally relates to a display device and a driving method thereof.

2. Related Art

With the development of information technologies, the importance of a display device as a medium to connect a user and information increases. Examples of display devices includes a liquid crystal display device, an organic light emitting display device, and a plasma display device.

A frequency of updating image frames, herein referred to as a driving frequency of a display device, may vary depending on a display mode. For example, pixels of the display device may be driven at a relatively high frequency in a normal mode of image display. Further, the pixels may be driven at a relatively low frequency in a standby mode in which no or limited information (e.g., time) may be displayed.

When the pixels are driven at a low frequency, various solutions have been considered to reduce power consumption of the display device. However, these solutions may have a side effect that a luminance deviation (e.g., flicker) caused by a sudden change in voltage or current is observable in a process of changing the driving frequency.

SUMMARY

Embodiments of the present disclosure provide a display device capable of reducing power consumption while preventing a luminance deviation from being observable to a user, and a driving method of the display device.

In accordance with an aspect of the present disclosure, a display device includes: pixels; and a power converter configured to receive a first voltage, convert the first voltage to a second voltage, and provide the second voltage to an output terminal to control the pixels, wherein the power converter includes: a first variable load connected to the output terminal of the power converter; a first comparator configured to provide a comparison result by comparing a difference between a first feedback voltage of the first voltage and a second feedback voltage of the second voltage; and a gap controller configured to control a magnitude of the first variable load o maintain the difference between the first voltage and the second voltage to be greater than or equal to a gap based on the comparison result received from the first comparator.

The first variable load may include a first switch having a first end connected to the output terminal of the power converter. The first switch may be in a turn-off state, in a first display mode in which the pixels display first image frames at a first driving frequency.

The first switch may be turned on in a second display mode in which the pixels display second image frames at a second driving frequency that is lower than the first driving frequency or in a switching period in which a display mode of the display device is switched from the first display mode to the second display mode.

The first variable load may further include a first variable resistor connected to a second end of the first switch. The gap controller may decrease a resistance value of the first variable resistor, when the difference between the first voltage and the second voltage is smaller than the gap.

The gap controller may increase the resistance value of the first variable resistor, when the difference between the first voltage and the second voltage is greater than or equal to the gap.

The power converter may further include: a first resistor having a first terminal connected to a first node to which the first voltage is applied and a second terminal connected to a second node; and a second resistor having a first terminal connected to the second node. The first feedback voltage of the first voltage may correspond to a voltage of the second node.

The power converter may further include: a third resistor having a first terminal connected to a third node that is connected to the output terminal of the power converter and a second terminal connected to a fourth node; and a fourth resistor having a first terminal connected to the fourth node. The second feedback voltage of the second voltage may correspond to a voltage of the fourth node.

The power converter may further include: a transistor having a first electrode connected to the first node and a second electrode connected to the third node; and a second comparator having a first input terminal to which a reference voltage is applied, a second input terminal connected to the fourth node, and an output terminal connected to a gate electrode of the transistor.

The display device may further include a power provider configured to receive an external input voltage, convert the external input voltage to the first voltage, and provide the first voltage to an output terminal. The power provider may include: a second variable load connected to the output terminal of the power provider; and a ripple controller configured to control a magnitude of the second variable load to maintain a decrement of first current per unit time to be smaller than or equal to a reference decrement. The first current may flow through the output terminal of the power provider.

The second variable load may include a second switch having a first end connected to the output terminal of the power provider. The second switch may be in the turn-off state, in an active data period in which grayscale values of the pixels are provided.

The second switch may be turned on in a vertical blank period in which the grayscale values of the pixels are not provided or in a case in which the active data period is switched to the vertical blank period.

The second variable load may further include a second variable resistor connected to a second end of the second switch. The ripple controller may decrease a resistance value of the second variable resistor, when the decrement of the first current is greater than the reference decrement.

The ripple controller may increase the resistance value of the second variable resistor, when the decrement of the first current is smaller than or equal to the reference decrement.

In accordance with another aspect of the present disclosure, a display device includes: pixels; and a power provider configured to receive an external input voltage, convert the external input voltage to a first voltage, and provide the first voltage to an output terminal to control the pixels, wherein the power provider includes: a variable load connected to the output terminal of the power provider; and a ripple controller configured to control a magnitude of the second variable load to maintain a decrement of first current per unit time to be smaller than or equal to a reference decrement. The first current may flow through the output terminal of the power provider.

The variable load may include a switch having a first end connected to the output terminal of the power provider. The switch may be in a turn-off state, in an active data period in which grayscale values of the pixels are provided.

The switch may be turned on in a vertical blank period in which the gray scale values of the pixels are not provided or in a case in which the active data period is switched to the vertical blank period.

The variable load may further include a variable resistor connected to a second end of the switch. The ripple controller may decrease a resistance value of the variable resistor, when the decrement of the first current is greater than the reference decrement.

The ripple controller may increase the resistance value of the variable resistor, when the decrement of the first current is smaller than or equal to the reference decrement.

In accordance with still another aspect of the present disclosure, a method for driving a display device includes: receiving, by a power converter of the display device, a first voltage, converting the first voltage to a second voltage, and providing the second voltage to an output terminal of the power converter; displaying, by pixels of the display device, first image frames at a first driving frequency, using the second voltage; displaying, by the pixels, second image frames at a second driving frequency that is lower than the first driving frequency, using the second voltage; and adjusting a magnitude of the second voltage to maintain a difference between the first voltage and the second voltage to be greater than or equal to a gap, in a period in which the pixels are driven at the second driving frequency or in a switching period in which a driving frequency of the pixels is switched from the first driving frequency to the second driving frequency.

In the adjusting of the magnitude of the second voltage, a magnitude of a first variable load connected to the output terminal of the power converter may be adjusted.

BRIEF DESCRIPTION OF THE DRAWINGS

Example embodiments will now be described more fully hereinafter with reference to the accompanying drawings; however, they may be embodied in different forms and/or configurations and should not be construed as limited to the embodiments set forth herein. Rather, these embodiments are provided so that the present disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout unless explicitly stated otherwise.

DETAILED DESCRIPTION

Figure 1:
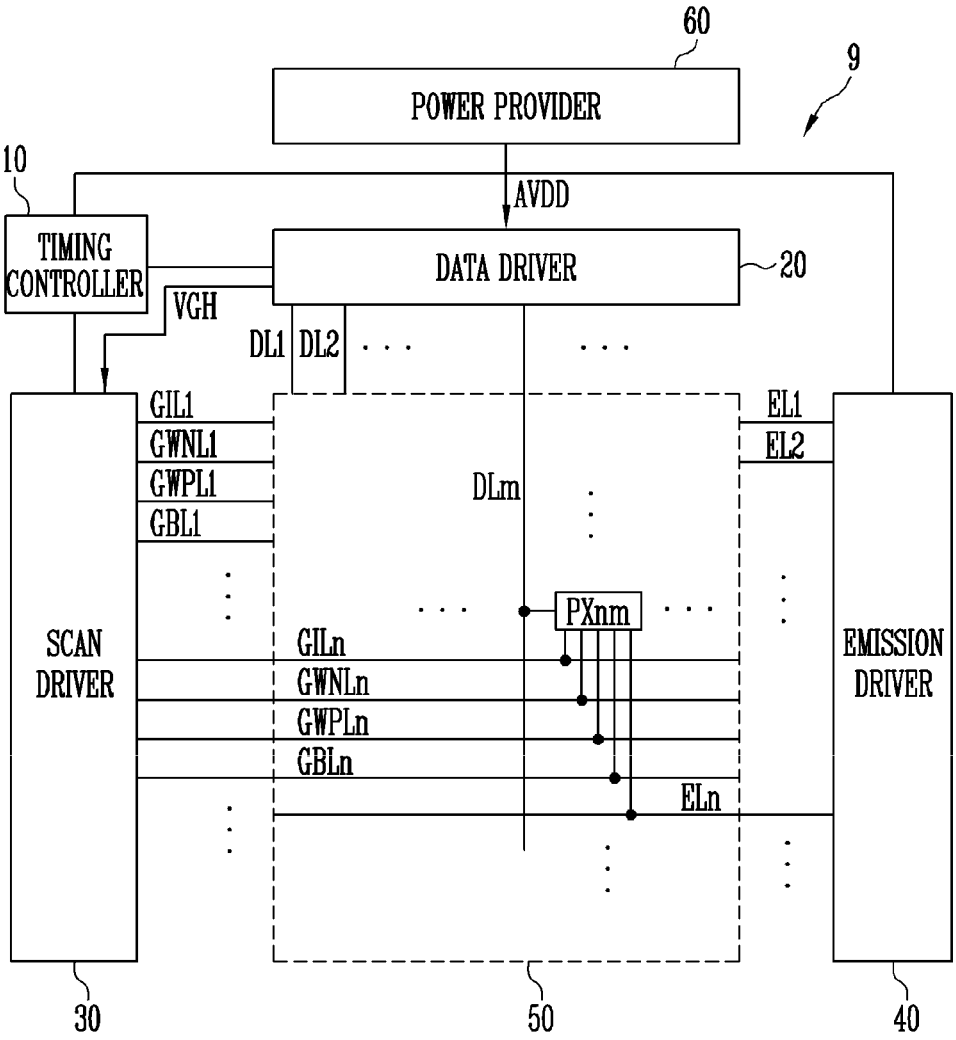
FIG. 1 is a diagram illustrating a display device in accordance with an embodiment of the present disclosure.

Hereinafter, exemplary embodiments of the present disclosure are described in detail with reference to the accompanying drawings so that those skilled in the art may easily practice the present disclosure. The present disclosure may be implemented in various different forms and/or configurations and is not limited to the exemplary embodiments described in the present disclosure.

Description irrelevant to the inventive concept may be omitted to clearly describe the present disclosure, and the same or similar constituent components/elements will be designated by the same reference numerals throughout the present disclosure. Therefore, the same reference numerals may be used in different drawings to identify the same or similar elements.

In addition, the size and thickness of each component/element illustrated in the drawings are arbitrarily shown for better understanding and ease of description, but the present disclosure is not limited thereto. Thicknesses of certain portions and regions may be exaggerated for clear expressions.

FIG. 1 is a diagram illustrating a display device in accordance with an embodiment of the present disclosure.

Referring to FIG. 1, the display device 9 may include a timing controller 10, a data driver 20, a scan driver 30, an emission driver 40, a pixel unit 50, and a power provider 60.

The timing controller 10 may receive an external input signal of an image frame from an external processor and generate various timing signals to drive the display device 9. For example, the timing controller 10 may provide grayscale values and various control signals to the data driver 20. In addition, the timing controller 10 may provide the scan driver 30 with a clock signal, a scan start signal, and the like. The timing controller 10 may further provide the emission driver 40 with a clock signal, an emission stop signal, and the like.

The power provider 60 may receive an external input voltage and convert the external input voltage, thereby providing a first voltage AVDD to an output terminal. In one embodiment, the power provider 60 may boost the external input voltage and provide the first voltage AVDD that is a voltage higher than the external input voltage.

For example, the power provider 60 may be configured as a Power Management Integrated Chip (PMIC). For example, the power provider 60 may be configured as an external direct current (DC)/DC integrated chip (IC).

Figure 7:
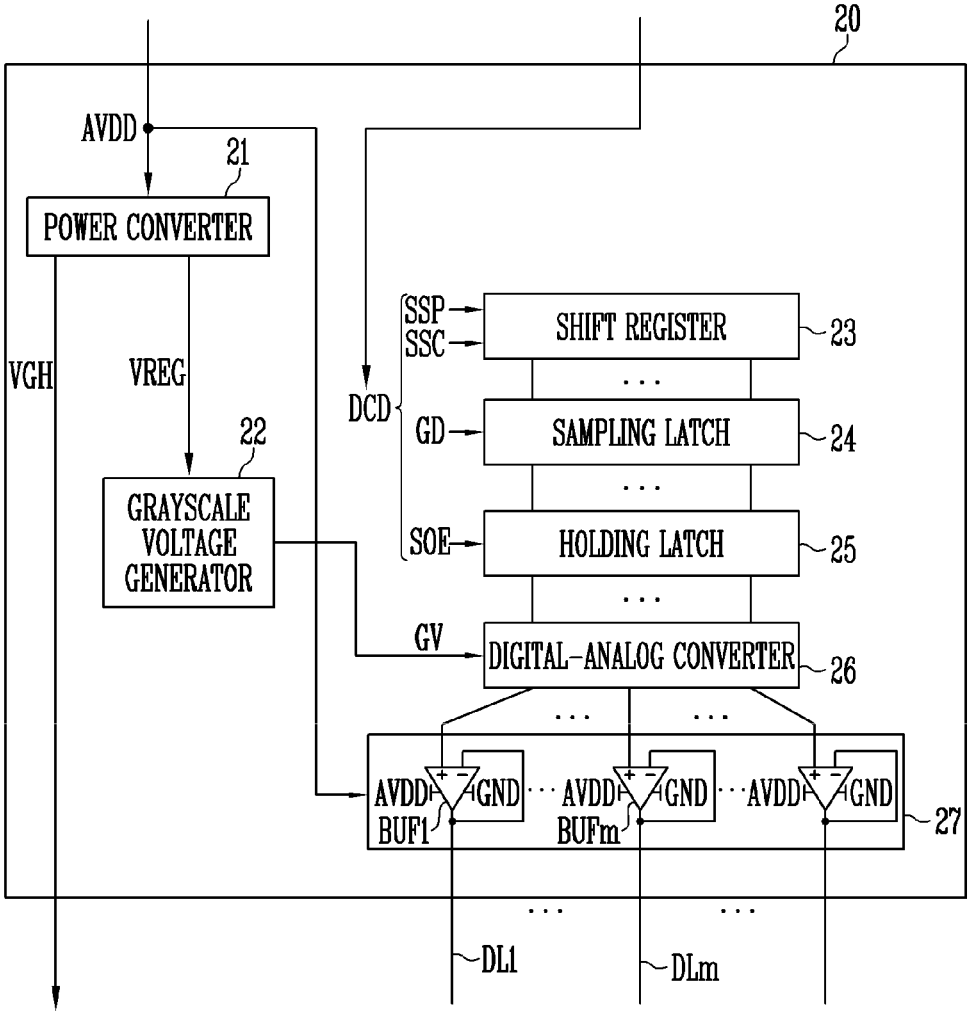
FIG. 7 is a diagram illustrating a data driver in accordance with an embodiment of the present disclosure.

The data driver 20 may receive various signals including grayscale values and control signals (e.g., display control data (DCD) shown in FIG. 7) from the timing controller 10 and provide data voltages to data lines DL1, DL2, . . . , and DLm. For example, the data driver 20 may sample the grayscale values using a clock signal that is also received from the timing controller 10 and provide data voltages corresponding to the grayscale values to the data lines DL1, DL2, . . . , and DLm in a unit of a pixel row (e.g., pixels connected to the same scan line). Here, m may be a natural number.

The data driver 20 may receive the first voltage AVDD from the power provider 60 and generate a second voltage VGH based on the first voltage AVDD to control the pixels included in the pixel unit 50. For example, the data driver 20 may be configured as an independent IC. In another example, the data driver 20 may be configured as an IC integrated with the timing controller 10.

The scan driver 30 may generate and provide scan signals to scan lines GILL GWNL1, GWPL1, GBL1, . . . , GILn, GWNLn, GWPLn, and GBLn using the clock signal, the scan start signal, and the like that are received from the timing controller 10. Here, n may be a natural number.

The scan driver 30 may include a plurality of sub-scan drivers. In an example, a first sub-scan driver may provide scan signals via the scan lines GILL . . . , and GILn, a second sub-scan driver may provide scan signals via the scan lines GWNL1, . . . , and GWNLn, a third sub-scan driver may provide scan signals via the scan lines GWPL1, . . . , and GWPLn, and a fourth sub-scan driver may provide scan signals via the scan lines GBL1, . . . , and GBLn. Each of the sub-scan drivers may include a plurality of scan stages connected in a shift register form. For example, the scan driver 30 may generate scan signals in a manner that sequentially transfers the scan start signal in the form of a pulse having a turn-on level to a next scan stage using the clock signal.

In one embodiment, the first and second sub-scan drivers may be integrated to provide scan signals of the scan lines GILL GWNL1, . . . , GILn, and GWNLn, and the third and fourth sub-scan drivers may be integrated to provide scan signals of the scan lines GWPL1, GBL1, . . . , GWPLn, and GBLn. For example, a previous scan line of an nth scan line GWNLn, i.e., an (n−1)th scan line GWNL(n−1) may be connected to the same electrical node as an nth scan line GILn. For example, a next scan line of an nth scan line GWPLn, i.e., an (n+1)th scan line GWPL(n+1) may be connected to the same electrical node as an nth scan line GBLn.

The first and second sub-scan drivers may supply scan signals having pulses of a first polarity to the scan lines GILL GWNL1, . . . , GILn, and GWNLn. In addition, the third and fourth sub-scan drivers may supply scan signals having pulses of a second polarity to the scan lines GWPL1, GBL1, . . . , GWPLn, and GBLn. The first polarity and the second polarity may have opposite polarities from each other.

Hereinafter, a polarity may be determined based on a logic level of a pulse. For example, when the pulse has the first polarity, the pulse may have a high level. The pulse having the high level may be referred to as a rising pulse. When the rising pulse is supplied to a gate electrode of an N-type transistor, the N-type transistor may be turned on. That is, the rising pulse may have a turn-on level with respect to a threshold level of the N-type transistor. In this case, it may be assumed that a voltage having a level sufficiently lower than that of the gate electrode of the N-type transistor is applied to a source electrode of the N-type transistor. For example, the N-type transistor may be an N-type metal-oxide-semiconductor (NMOS) transistor.

In addition, when the pulse has the second polarity, the pulse may have a low level. The pulse having the low level may be referred to as a falling pulse. When the falling pulse is supplied to a gate electrode of a P-type transistor, the P-type transistor may be turned on. That is, the falling pulse may be a turn-on level with respect to a threshold level of the P-type transistor. In this case, it may be assumed that a voltage having a level sufficiently higher than that of the gate electrode of the P-type transistor is applied to a source electrode of the P-type transistor. For example, the P-type transistor may be a P-type metal-oxide-semiconductor (PMOS) transistor.

The scan driver 30 may generate scan signals using the second voltage VGH. In an example, scan signals may have the high level that corresponds to the second voltage VGH. In this case, the second voltage VGH is output to a scan stage so that a scan signal having the high level (the level of the second voltage VGH) is output. In another example, the scan stage does not directly output the second voltage VGH but may use the second voltage VGH as an internal control voltage to generate the rising pulse or falling pulse.

The emission driver 40 may generate emission signals and provide the emission signals to emission lines EL1, EL2, . . . , and ELn using the signals received from the timing controller 10, for example, the clock signal, the emission stop signal, and the like. For example, the emission driver 40 may sequentially provide the emission signals in the form of a pulse having a turn-off level to the emission lines EL1, EL2, . . . , and ELn. The emission driver 40 may be configured in a shift register form and generate the emission signals by providing the emission stop signal in the form of a pulse having the turn-off level to an emission line and sequentially transferring the emission stop signal to a next emission stage under the control of the clock signal.

The pixel unit 50 includes a plurality of pixels. For example, a pixel PXnm in an n-th pixel row and an m-th pixel column may be connected to a corresponding data line DLm, corresponding scan lines GILn, GWNLn, GWPLn, and GBLn, and a corresponding emission line ELn.

Figure 2:
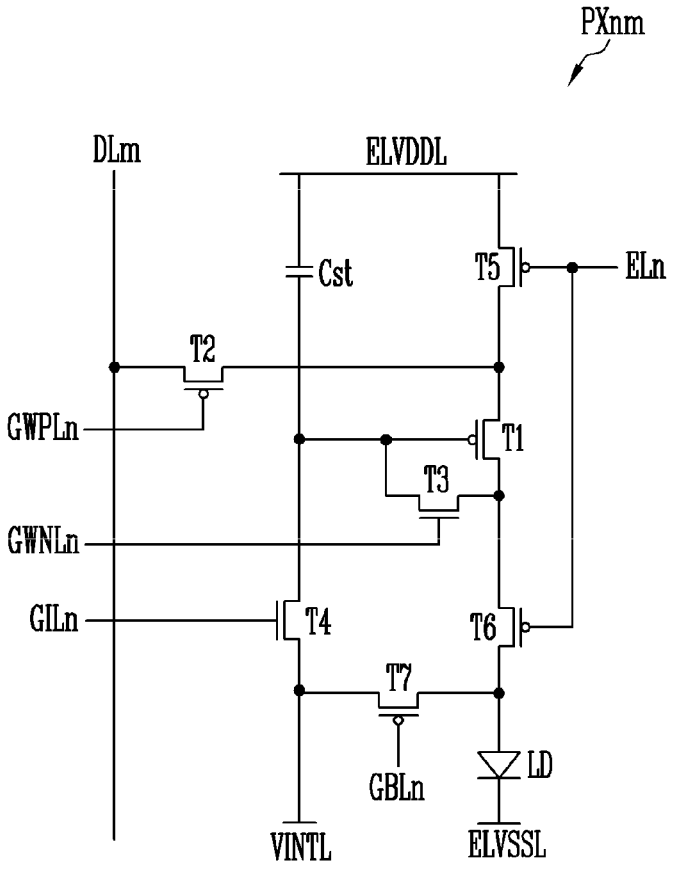
FIG. 2 is a diagram illustrating a pixel in accordance with an embodiment of the present disclosure.

FIG. 2 is a diagram illustrating a pixel in accordance with an embodiment of the present disclosure.

Referring to FIG. 2, the pixel PXnm may include a first transistor T1, a second transistor T2, a third transistor T3, a fourth transistor T4, a fifth transistor T5, a sixth transistor T6, and a seventh transistor T7, a storage capacitor Cst, and a light emitting diode LD.

A first electrode of the first transistor T1 may be connected to a first electrode of the second transistor T2, a second electrode of the first transistor T1 may be connected to a first electrode of the third transistor T3, and a gate electrode of the first transistor T1 may be connected to a second electrode of the third transistor T3. The first transistor T1 may be referred to as a driving transistor.

The first electrode of the second transistor T2 may be connected to the first electrode of the first transistor T1, a second electrode of the second transistor T2 may be connected to a data line DLm, and a gate electrode of the second transistor T2 may be connected to a scan line GWPLn. The second transistor T2 may be referred to as a scan transistor.

The first electrode of the third transistor T3 may be connected to the second electrode of the first transistor T1, the second electrode of the third transistor T3 may be connected to the gate electrode of the first transistor T1, and a gate electrode of the third transistor T3 may be connected to a scan line GWNLn. The third transistor T3 may be referred to as a diode connection transistor.

A first electrode of the fourth transistor T4 may be connected to a second electrode of the storage capacitor Cst, a second electrode of the fourth transistor T4 may be connected to an initialization line VINTL, and a gate electrode of the fourth transistor T4 may be connected to a scan line GILn. The fourth transistor T4 may be referred to as a gate initialization transistor.

A first electrode of the fifth transistor T5 may be connected to a first power line ELVDDL, a second electrode of the fifth transistor T5 may be connected to the first electrode of the first transistor T1, and a gate electrode of the fifth transistor T5 may be connected to an emission line ELn. The fifth transistor T5 may be referred to as a first emission transistor.

A first electrode of the sixth transistor T6 may be connected to the second electrode of the first transistor T1, a second electrode of the sixth transistor T6 may be connected to an anode of the light emitting diode LD, and a gate electrode of the sixth transistor T6 may be connected to the emission line ELn. The sixth transistor T6 may be referred to as a second emission transistor.

A first electrode of the seventh transistor T7 may be connected to the anode of the light emitting diode LD, a second electrode of the seventh transistor T7 may be connected to the initialization line VINTL, and a gate electrode of the seventh transistor T7 may be connected to a scan line GBLn. The seventh transistor T7 may be referred to as an anode initialization transistor.

A first electrode of the storage capacitor Cst may be connected to the first power line ELVDDL, and the second electrode of the storage capacitor Cst may be connected to the gate electrode of the first transistor T1.

The anode of the light emitting diode LD may be connected to the second electrode of the sixth transistor T6, and a cathode of the light emitting diode LD may be connected to a second power line ELVSSL. A voltage applied to the second power line ELVSSL may be set lower than that applied to the first power line ELVDDL. The light emitting diode LD may be an organic light emitting diode, an inorganic light emitting diode, a quantum dot light emitting diode, or the like.

According to one embodiment, the first transistor T1, the second transistor T2, the fifth transistor T5, the sixth transistor T6, and the seventh transistor T7 may be implemented with a P-type transistor. Channels of the first transistor T1, the second transistor T2, the fifth transistor T5, the sixth transistor T6, and the seventh transistor T7 may be configured with poly-silicon. The poly-silicon transistor may be a Low Temperature Poly-Silicon (LTPS) transistor. The poly-silicon transistor has high electron mobility and has a fast driving characteristic due to the high electron mobility.

According to one embodiment, the third transistor T3 and the fourth transistor T4 may be implemented with an N-type transistor. Channels of the third transistor T3 and the fourth transistor T4 may be configured with an oxide semiconductor. The oxide semiconductor transistor may be formed through a low temperature process and has a charge mobility lower than that of the poly-silicon transistor. Thus, an amount of leakage current of the oxide semiconductor transistor that is generated in a turn-off state is smaller than that of the poly-silicon transistor.

In some embodiments, the seventh transistor T7 may be configured with an N-type oxide semiconductor transistor instead of the poly-silicon transistor. In substitute for the scan line GBLn, one of the scan lines GWNLn and GILn may be connected to the gate electrode of the seventh transistor T7.

Figure 3:
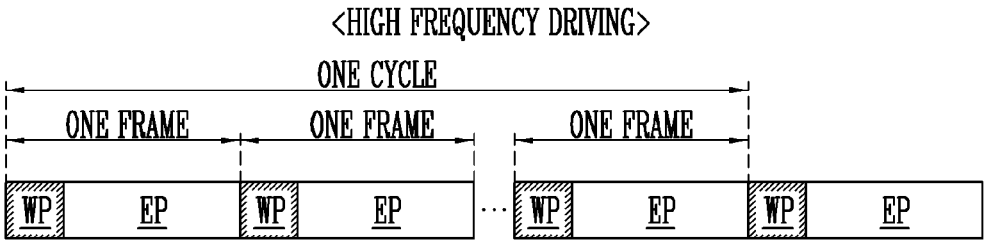
FIG. 3 is a diagram illustrating a case where the pixel is driven according to a first driving frequency.

FIG. 3 is a diagram illustrating a case where the pixel is driven according to a first driving frequency.

When the pixels display image frames at the first driving frequency, the display device 9 is in a first display mode. Similarly, when the pixels display image frames at a second driving frequency that is lower than the first driving frequency, the display device 9 is in a second display mode.

In the first display mode, the display device 9 may display image frames at 20 Hz or higher, e.g., 60 Hz.

The second display mode may be a low power display mode. For example, in a standby mode, image frames may be displayed at less than 20 Hz, e.g., 1 Hz. For example, a display mode in which only time and date are displayed, herein also referred to as an "always on mode," during a common-use display mode may correspond to the second driving mode.

In the first display mode, one cycle may include a plurality of image frames. The one cycle may be an arbitrarily defined period that is defined to compare the first display mode and the second display mode. For convenience of description, the one cycle may refer to the same time interval in the first display mode and the second display mode. However, it is noted that the duration of the one cycle may vary depending on the display mode without deviating from the scope of the present disclosure.

In the first display mode, each of the image frames may include a data write period WP and an emission period EP.

Hereinafter, a driving method of the pixel PXnm with respect to one arbitrary image frame in one cycle will be described with reference to FIG. 4. The same driving method may also be applied to other image frames in the same one cycle, and therefore, overlapping descriptions will be omitted.

Figure 4:
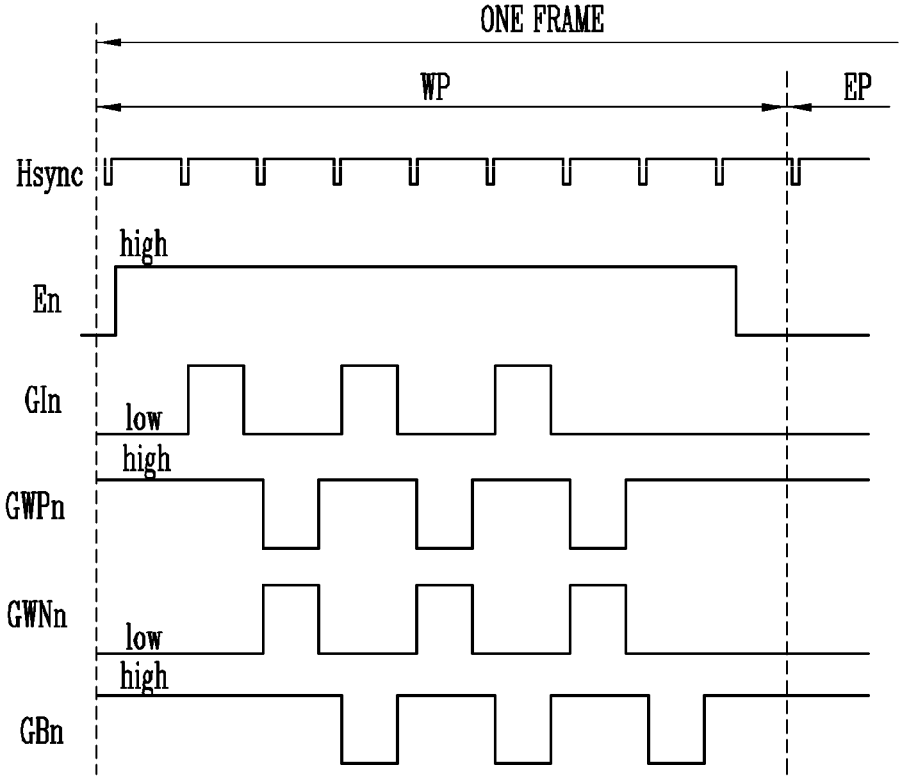
FIG. 4 is a diagram illustrating a data write period of the pixel in accordance with an embodiment of the present disclosure.

FIG. 4 is a diagram illustrating a data write period of the pixel in accordance with an embodiment of the present disclosure.

As described above, one image frame may include a data write period WP and an emission period EP in the first display mode. However, in this embodiment, the data write period WP and the emission period EP correspond to the specific pixel PXnm or the n-th pixel row (e.g., pixels connected to the same scan line), and therefore, a data write period and an emission period of another pixel in a different pixel row that is connected to another scan line may be different from those of the pixel PXnm.

Hsync is a horizontal synchronization signal having a plurality of pulses which indicating an end of a previous horizontal period and a start of a current horizontal period. In each horizontal period, each of the data voltages may be supplied to each of the data lines DL1, DL2, . . . , DLm. An emission signal En having a turn-off level (e.g., high level) may be supplied to the emission line ELn during the data write period WP. Therefore, the fifth transistor T5 and the sixth transistor T6 may be in a turn-off state during the data write period WP.

First, a scan signal GIn including a first pulse having a turn-on level (e.g., high level) is supplied to the scan line GILn. Accordingly, the fourth transistor T4 is turned on, and the gate electrode of the first transistor T1 and the initialization line VINTL are connected to each other. Accordingly, a voltage of the gate electrode of the first transistor T1 is initialized to an initialization voltage of the initialization line VINTL and is maintained by the storage capacitor Cst. For example, the initialization voltage of the initialization line VINTL may be a voltage sufficiently lower than a voltage of the first power line ELVDDL. For example, the initialization voltage may be a voltage having a level similar to that of the voltage of the first power line ELVDDL.

Next, scan signals GWPn and GWNn including first pulses having the turn-on level are supplied to the scan lines GWPLn and GWNLn, and the second transistor T2 and the third transistor T3 are turned on. Accordingly, a data voltage applied to the data line DLm is transferred to the storage capacitor Cst through the second transistor T2, the first transistor T1, and the third transistor T3. In one embodiment, the data voltage is applied to the data line DLm in more than one times during the data write period WP, and the data voltage applied to the data line DLm may be a data voltage applied to a previous pixel except the last one. In this case, the data voltage that is applied to the previous pixel may not be used for emission of the pixel PXnm but is instead used to apply an on-bias voltage to the first transistor T1. When the on-bias voltage is applied before an actual data voltage is applied to the first transistor T1, a hysteresis phenomenon can be minimized.

Next, a scan signal GBn including a first pulse having a turn-on level (e.g., low level) is supplied to the scan line GBLn, and the seventh transistor T7 is turned on. Therefore, an anode voltage of the light emitting diode LD is initialized with the initialization voltage of the initialization line VINTL.

A second pulse having the turn-on level (e.g., high level) is supplied to the scan line GILn, and the described-above driving process is again performed. That is, the on-bias voltage is again applied to the first transistor T1, and the anode voltage of the light emitting diode LD is initialized.

By repeating the above-described process, when third pulses having the turn-on level are supplied to the scan lines GWPLn and GWNLn, a data voltage of the pixel PXnm is applied to the storage capacitor Cst. The data voltage applied to the storage capacitor Cst may correspond to a voltage that is obtained by reflecting a decrement of a threshold voltage of the first transistor T1.

Finally, when the emission signal En is changed to the turn-on level (low level), the fifth transistor T5 and the sixth transistor T6 become a turn-on state. Accordingly, a driving current path connecting the first power line ELVDDL, the fifth transistor T5, the first transistor T1, and the sixth transistor T6, the light emitting diode LD, and the second power line ELVSSL is formed, and a driving current flows through the driving current path. An amount of driving current corresponds to the data voltage stored in the storage capacitor Cst. Since the driving current flows through the first transistor T1, a decrement of the threshold voltage of the first transistor T1 may be reflected to the driving current. Accordingly, the decrement of the threshold voltage, which is reflected to the data voltage stored in the storage capacitor Cst, and the decrement of the threshold voltage, which is reflected to the driving current, are cancelled with each other, and thus the driving current corresponding to the data voltage can flow regardless of the threshold voltage of the first transistor T1.

The light emitting diode LD emits light with a desired luminance according to the amount of driving current that corresponds to the data voltage.

In the present embodiment, a case where each scan signal includes three pulses is described. However, in another embodiment, each scan signal may include two or four or more pulses. In still another embodiment, each scan signal may include only one pulse, and the process of applying the on-bias voltage to the first transistor T1 may be omitted.

Figure 5:
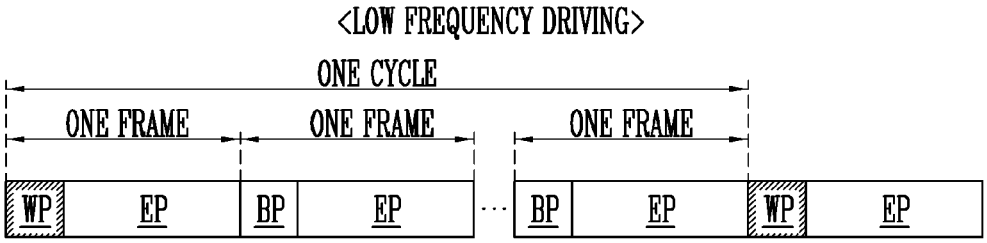
FIG. 5 is a diagram illustrating a case where the pixel is driven according to a second driving frequency.

FIG. 5 is a diagram illustrating a case where the pixel is driven according to the second driving frequency.

In the second display mode, one image frame during one cycle includes a data write period WP and an emission period EP, and each of other image frames during the one cycle includes a bias period BP and an emission period EP. In one embodiment, as shown in FIG. 5, the first image frame includes the data write period WP and the emission period EP, and the subsequent image frame(s) include(s) the bias period BP and the emission period EP. However, it is understood that the image frame including the data write period WP and the emission period EP may appear in a different order during the one cycle, for example, second, third, etc. without deviating from the scope of the present disclosure.

The third transistor T3 and the fourth transistor T4 of the pixel PXnm maintain the turn-off state in the other image frames during the one cycle except the image frame including the data write period WP and the emission period EP, and the storage capacitor Cst maintains the same data voltage during the one cycle. In particular, the third transistor T3 and the fourth transistor T4 may be configured as oxide semiconductor transistors to minimize leakage current.

Thus, the pixel PXnm can display the same image during the one cycle based on a data voltage supplied during the data write period WP of the one image frame in the one cycle.

Figure 6:
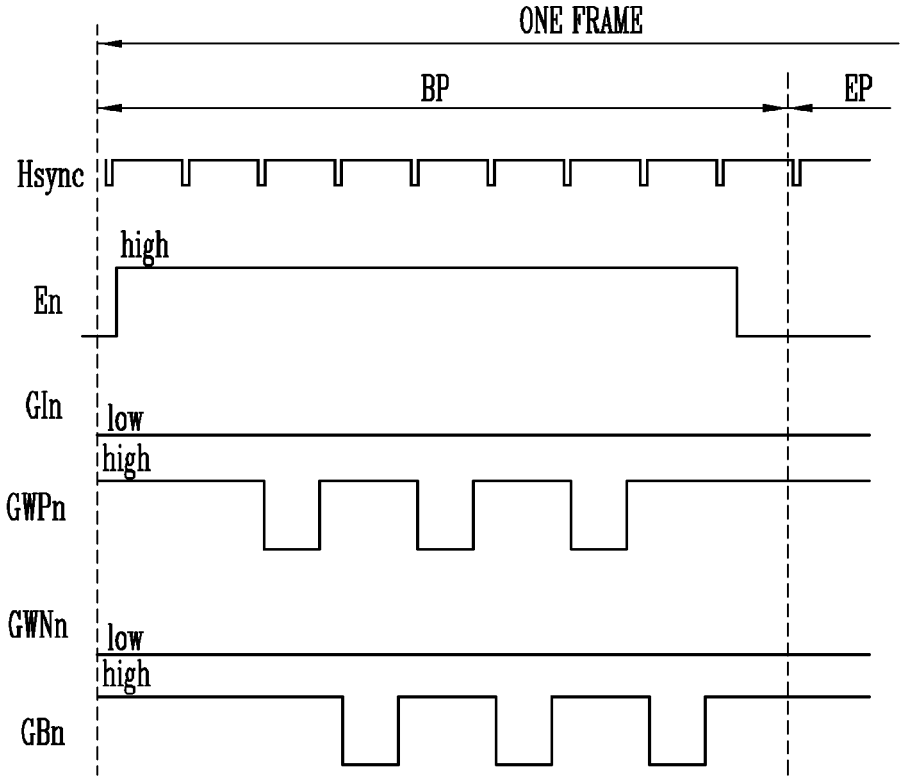
FIG. 6 is a diagram illustrating a bias period of the pixel in accordance with an embodiment of the present disclosure.

FIG. 6 is a diagram illustrating a bias period of the pixel in accordance with an embodiment of the present disclosure.

Referring to FIG. 6, in the bias period BP, the scan signals GIn and GWNn having a turn-off (low level) are supplied to the scan lines GILn and GWNLn. Therefore, as described above, a data voltage applied to the storage capacitor Cst is not changed in the bias period BP.

However, in the bias period BP and the data write period WP, the same emission signal En and the same scan signals GWPn and GBn may be supplied to the emission line ELn and scan lines GWPLn and GBLn. A reference data voltage may be applied to the data line DLm in the bias period BP. Therefore, wavelengths of lights that are output from the light emitting diode LD are similar to each other between the plurality of image frames of the one cycle, and it can prevent a flicker that may be observable to a user in low frequency driving.

The pixel PXnm described with reference to FIGS. 1 to 6 may be suitable for high frequency driving and low frequency driving. Embodiments that will be described later may be applied to a pixel having another circuit, but the same high frequency driving and low frequency driving can be performed. For example, transistors of the pixel may all be configured as only P-type transistors. Thus, the scan driver 30 includes only a sub-scan driver of the P-type transistors, and, accordingly, the configuration of the scan driver 30 can be simplified. For example, the transistors of the pixel may not include emission transistors. Therefore, the emission driver 40 shown in FIG. 1 may be unnecessary.

FIG. 7 is a diagram illustrating a data driver in accordance with an embodiment of the present disclosure.

Referring to FIG. 7, the data driver 20 may include a power converter 21, a grayscale voltage generator 22, a shift register 23, a sampling latch 24, a holding latch 25, a digital-analog converter 26, and an output buffer 27.

The power converter 21 may receive the first voltage AVDD and provide the second voltage VGH to an output terminal by converting the first voltage AVDD to control the pixels. For example, the second voltage VGH may be provided to the scan driver 30 as shown in FIG. 1.

In addition, the power converter 21 may receive the first voltage AVDD and provide a first high voltage VREG to the output terminal by converting the first voltage AVDD to control the pixels. The first high voltage VREG may be provided to the grayscale voltage generator 22.

Hereinafter, an exemplary embodiment will be described in which the second voltage VGH is higher than the first high voltage VREG in a general situation. Since a difference between the first voltage AVDD and the second voltage VGH is smaller than that between the first voltage AVDD and the first high voltage VREG, a probability of voltage reversal for the second voltage VGH to become higher than the first voltage AVDD is higher than that for the first high voltage VREG to become higher than the first voltage AVDD. A voltage reversal phenomenon will be discussed in further detail with respect to FIG. 10.

In some embodiments, the first high voltage VREG may be higher than the second voltage VGH. Therefore, the following embodiments may be modified and applied to appropriately maintain the first voltage AVDD and the first high voltage VREG, instead of focusing on the difference between the first voltage AVDD and the second voltage VGH.

The grayscale voltage generator 22 may generate grayscale voltages GV using the first high voltage VREG. Since the grayscale voltages GV generated by the grayscale voltage generator 22 are used to display an image frame, the grayscale voltages GV may be provided corresponding to colors of the pixels. In one embodiment, the grayscale voltage generator 22 may include a first color grayscale voltage generator for providing a first color, a second color grayscale voltage generator for providing a second color, and a third color grayscale voltage generator for providing a third color. For example, the first color may be red, the second color may be green, and the third color may be blue.

A display control data DCD received from the timing controller 10 may include, but is not limited to, a source start pulse SSP, a source shift clock SSC, grayscale values GD, and a source output enable SOE.

The shift register 23 may include a plurality of registers and sequentially generate sampling signals while shifting the source start pulse SSP for each period of the source shift clock SSC. A number of the sampling signals may correspond to that of the data lines DL1 to DLm. In an example, the number of the sampling signals may be equal to that of the data lines DL1 to DLm. In another example, the display device 9 may further include a demultiplexer between the data driver 20 and the data lines DL1 to DLm. In this case, the number of the sampling signals may be smaller than that of the data lines DL1 to DLm. For convenience of description, in the following embodiments it is assumed that the demultiplexer does not exist in the display device 9.

The sampling latch 24 may include a plurality of sampling latches, and the number of the sampling latches may correspond to that of the data lines DL1 to DLm. The sampling latch 24 may sequentially receive the grayscale values GD of an image frame from the timing controller 10 and store the grayscale values GD in corresponding sampling latches in response to the sampling signals sequentially supplied from the shift register 23.

The holding latch 25 may include a plurality of holding latches, and the number of the holding latches may correspond to that of the data lines DL1 to DLm. The holding latch 25 may store, in the respective ones of the holding latches, the grayscale values GD stored in the sampling latches when the source output enable SOE is received.

The digital-analog converter 26 may include a plurality of digital-analog converters, and the number of the digital-analog converters may correspond to that of the data lines DL1 to DLm. For example, the number of digital-analog converters may be equal to that to the data lines DL1 to DLm. Each of the plurality of digital-analog converters may apply the grayscale voltage GV corresponding to a grayscale value GD stored in the corresponding holding latch and provide the grayscale voltage GV to a corresponding data line DLm.

The output buffer 27 may include a plurality of buffers BUF1 to BUFm. For example, each of the buffers BUF1 to BUFm may be an operational amplifier. Each of the buffers BUF1 to BUFm may be configured in the form of a voltage follower to apply an output of a corresponding digital-analog converter in the digital-analog converter 26 to a corresponding data line. For example, an inverting terminal of each of the buffer s BUF1 to BUFm may be connected to an output terminal of the buffer, and a non-inverting terminal of the buffer may be connected to an output terminal of the corresponding digital-analog converter. The output signals of the buffer s BUF1 to BUFm may be data voltage signals.

For example, an output terminal of an mth buffer BUFm may be connected to an mth data line DLm, and receive a buffer power voltage and a ground power voltage GND. In one embodiment, the buffer power voltage may be the first voltage AVDD. The buffer power voltage may determine an upper limit of an output voltage (i.e., a data voltage) of the buffer BUFm. In addition, the ground power voltage GND may determine a lower limit of the output voltage of the buffer BUFm. Depending on a configuration of the data driver 20, the buffer BUFm may be further applied with other voltages instead of or in addition to the buffer power voltage and the ground power voltage GND. The other voltages may be control voltages for determining a slew rate of the buffer BUFm. The control voltages may be different from the buffer power voltage and the ground power voltage GND because the control voltages are not voltages for determining the upper or lower limit of the output voltage of the buffer member BUFm.

Figure 8:
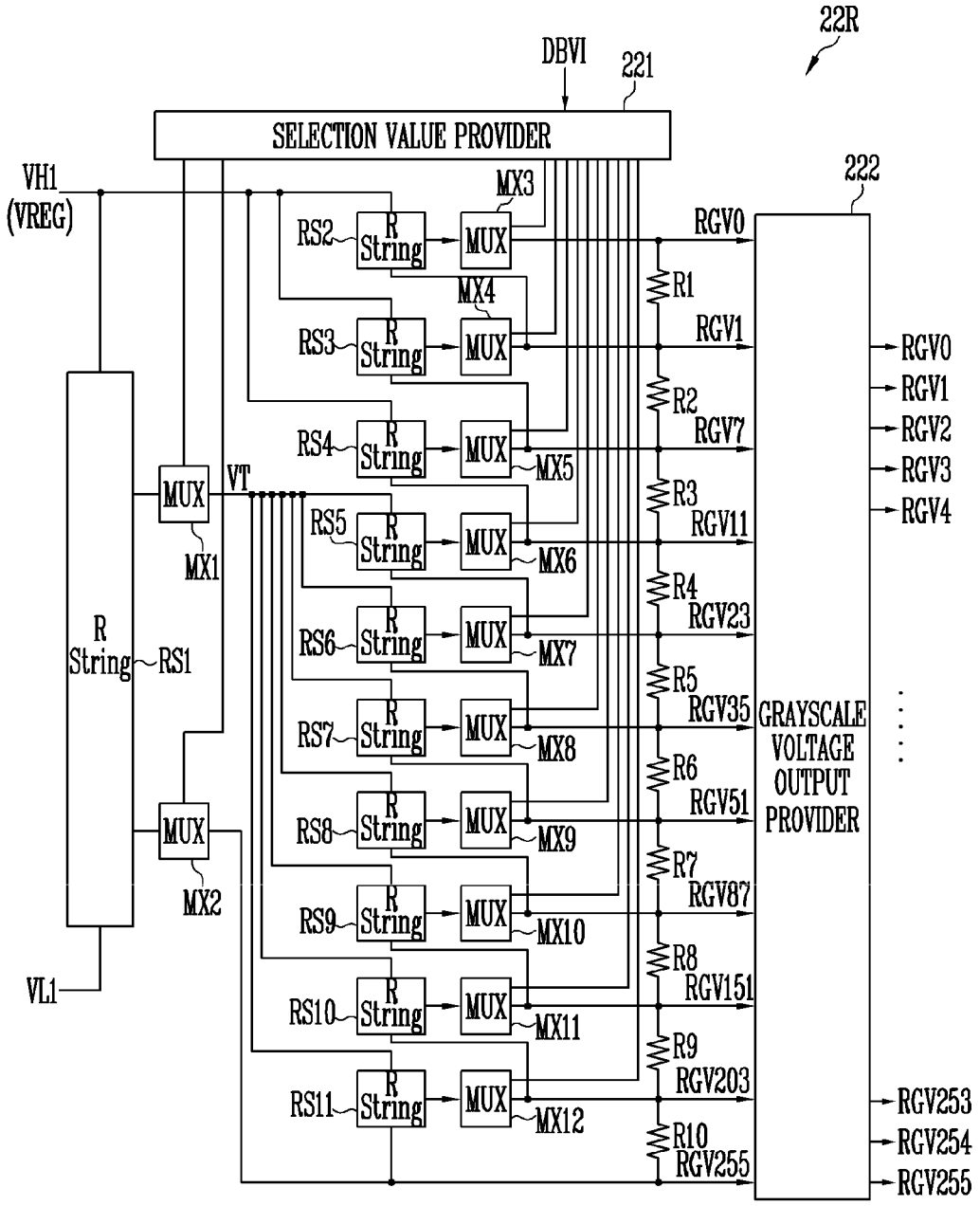
FIGS. 8 and 9 are diagrams illustrating a grayscale voltage generator in accordance with an embodiment of the present disclosure.
Figure 9:
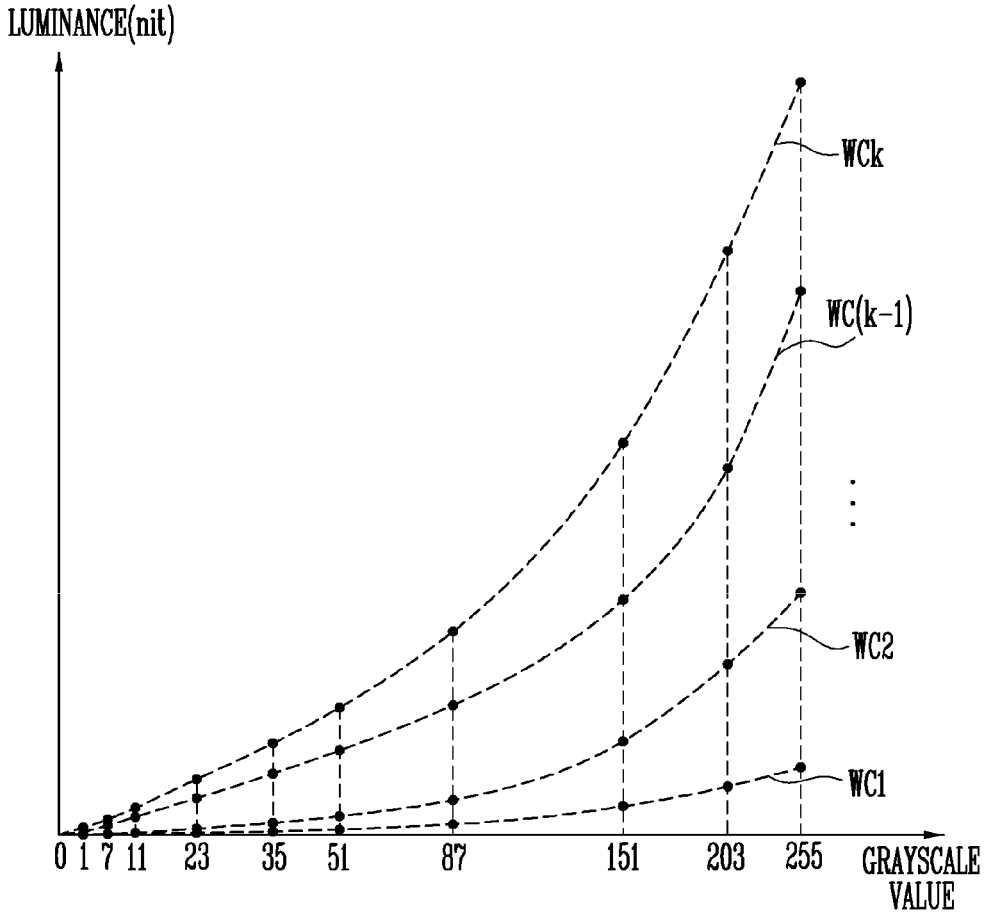

FIGS. 8 and 9 are diagrams illustrating a grayscale voltage generator in accordance with an embodiment of the present disclosure.

FIG. 8 shows an exemplary embodiment of a first color grayscale voltage generator 22R. Other color grayscale voltage generators may be configured identical or substantially similar to the first color grayscale voltage generator 22R, and therefore, overlapping descriptions will be omitted. Each of the color grayscale voltage generators may include a plurality of selection value providers. However, it is noted that selection values stored in a selection value provider 221 of the first color grayscale voltage generator 22R may be different from those stored in the selection value providers of the other color grayscale voltage generators.

The first color grayscale voltage generator 22R may include the selection value provider 221, a grayscale voltage output provider 222, resistor strings RS1 to RS11, multiplexers MX1 to MX12, and resistors R1 to R10.

The selection value provider 221 may provide selection values to the multiplexers MX1 to MX12 according to an input maximum luminance value DBVI. The selection values according to the input maximum luminance value DBVI may be pre-stored in a storage device, e.g., a memory device, a buffer, and a register.

Hereinafter, for convenience of description, an 8-bit grayscale having a total of 256 grayscale values ranging from grayscale 0 (minimum grayscale) to grayscale 255 (maximum grayscale) is described as a non-limiting example. However, the grayscale value GD may be expressed with other than 8 bits, therefore a smaller or larger number of grayscales may be used without deviating from the scope of the present disclosure. The minimum grayscale may correspond to the darkest grayscale, and the maximum grayscale may correspond the brightest grayscale.

A maximum luminance value may correspond to a luminance value of lights emitted from each of the pixels, corresponding to the maximum grayscale. For example, the maximum luminance value may be a luminance value of white color light that is generated when a first pixel of a first color emits light corresponding to the grayscale 255, a second pixel of a second color emits light corresponding to the grayscale 255, and a third pixel of a third color emits light corresponding to the grayscale 255. The pixel of the first color, the pixel of the second color, and the pixel of the third color may correspond to sub-pixels of each pixel of the plurality of pixels. The unit of luminance value may be nit.

Each of the pixels may display a partially (spatially) dark or bright image frame, but the maximum brightness of the image frame may be limited to the maximum luminance value. The maximum luminance value may be manually set by manipulation of a user with respect to the display device 9, or be automatically set by an algorithm associated with an illumination sensor, etc. The set maximum luminance value is herein referred to as the input maximum luminance value DBVI. The first color grayscale voltage generator 22R may be configured to directly receive the input maximum luminance value DBVI from an external processor, or may be configured to receive the input maximum luminance value DBVI from the timing controller 10.

The maximum luminance value may vary depending on display devices. However, for example, the maximum value of the maximum luminance value may be 1200 nits, and the minimum value of the maximum luminance value may be 4 nits. When the input maximum luminance value DBVI varies with respect to the same grayscale value GD, different grayscale voltages may be provided from the first color grayscale voltage generator 22R, and therefore, the light emitting luminance of the pixel may vary.

The resistor string RS1 may generate the first high voltage VREG that is applied to a high-voltage terminal VH1 and various intermediate voltages that are applied to a first low-voltage terminal VL1. The multiplexer MX1 may output a reference voltage VT by selecting one of the intermediate voltages provided from the resistor string RS1 according to a selection value received from the selection value provider 221. The multiplexer MX2 may output a 255-grayscale voltage RGV255 by selecting one of the intermediate voltages provided from the resistor string RS1 according to a selection value received from the selection value provider 221.

The resistor string RS11 may generate intermediate voltages between the reference voltage VT and the 255-grayscale voltage RGV255. The multiplexer MX12 may output a 203-grayscale voltage RGV203 by selecting one of the intermediate voltages provided from the resistor string RS11 according to a selection value received from the selection value provider 221.

The resistor string RS10 may generate intermediate voltages between the reference voltage VT and the 203-grayscale voltage RGV203. The multiplexer MX11 may output a 151-grayscale voltage RGV151 by selecting one of the intermediate voltages provided from the resistor string RS10 according to a selection value received from the selection value provider 221.

The resistor string RS9 may generate intermediate voltages between the reference voltage VT and the 151-grayscale voltage RGV151. The multiplexer MX10 may output an 87-grayscale voltage RGV87 by selecting one of the intermediate voltages provided from the resistor string RS9 according to a selection value received from the selection value provider 221.

The resistor string RS8 may generate intermediate voltages between the reference voltage VT and the 87-grayscale voltage RGV87. The multiplexer MX9 may output a 51-grayscale voltage RGV51 by selecting one of the intermediate voltages provided from the resistor string RS8 according to a selection value received from the selection value provider 221.

The resistor string RS7 may generate intermediate voltages between the reference voltage VT and the 51-grayscale voltage RGV51. The multiplexer MX8 may output a 35-grayscale voltage RGV35 by selecting one of the intermediate voltages provided from the resistor string RS7 according to a selection value received from the selection value provider 221.

The resistor string RS6 may generate intermediate voltages between the reference voltage VT and the 35-grayscale voltage RGV35. The multiplexer MX7 may output a 23-grayscale voltage RGV23 by selecting one of the intermediate voltages provided from the resistor string RS6 according to a selection value received from the selection value provider 221.

The resistor string RS5 may generate intermediate voltages between the reference voltage VT and the 23-grayscale voltage RGV23. The multiplexer MX6 may output an 11-grayscale voltage RGV11 by selecting one of the intermediate voltages provided from the resistor string RS5 according to a selection value received from the selection value provider 221.

The resistor string RS4 may generate intermediate voltages between the first high voltage VREG and the 11-grayscale voltage RGV11. The multiplexer MX5 may output a 7-grayscale voltage RGV7 by selecting one of the intermediate voltages provided from the resistor string RS4 according to a selection value received from the selection value provider 221.

The resistor string RS3 may generate intermediate voltages between the first high voltage VREG and the 7-grayscale voltage RGV7. The multiplexer MX4 may output a 1-grayscale voltage RGV1 by selecting one of the intermediate voltages provided from the resistor string RS3 according to a selection value received from the selection value provider 221.

The resistor string RS2 may generate intermediate voltages between the first high voltage VREG and the 1-grayscale voltage RGV1. The multiplexer MX3 may output a 0-grayscale voltage RGV0 by selecting one of the intermediate voltages provided from the resistor string RS2 according to a selection value received from the selection value provider 221.

The above-described grayscale numbers 0, 1, 7, 11, 23, 35, 51, 87, 151, 203, and 255 may be referred to as reference grayscales. In addition, the grayscale voltages RGV0, RGV1, RGV 7, RGV11, RGV23, RGV35, RGV51, RGV87, RGV151, RGV203, and RGV255 generated from the multiplexers MX2 to MX12 may be referred to as reference grayscale voltages. The number of reference grayscales and grayscale numbers corresponding to the reference grayscales may be differently set depending on the display device. Hereinafter, for convenience of description, the grayscale numbers 0, 1, 7, 11, 23, 35, 51, 87, 151, 203, and 255 are described as reference grayscales.

The grayscale voltage output provider 222 may generate other color grayscale voltages among the color grayscale voltages RGV0 to RGV255 by dividing the reference grayscale voltages RGV0, RGV0, RGV11, RGV23, RGV35, RGV51, RGV87, RGV151, RGV203, and RGV255. For example, the grayscale voltage output provider 222 may generate color grayscale voltages RGV2 to RGV6 by dividing the reference grayscale voltages RGV1 and RGV7 by using a resistor string.

Referring to FIG. 9, white color light curves WC1, WC2, . . . , WC(k−1), and WCk of output luminance with respect to grayscale values are shown. Here, k may be a natural number.

Maximum luminance values of the white color light curves WC1 to WCk may be different from one another. For example, the maximum luminance (e.g., 4 nits) of the white color light curve WC1 may be lowest, and the maximum luminance value (e.g., 1200 nits) of the white color light curve WCk may be highest.

To generate white color light, it is assumed that the pixels of all colors receive data voltages with respect to the same grayscale.

Imaginary dots illustrated on the white color light curves WC1 to WCk shown in FIG. 9 may correspond to the selection values that are pre-stored in the selection value provider 221 as described above. More accurate white color light curves may be directly expressed as the number of selection values is increased. However, more physical devices such as multiplexers, registers, etc. corresponding to the increased number of selection values are required. Accordingly, the selection values with respect to the above-described reference grayscale voltages may be pre-stored and used, and the other grayscale voltages may be generated by dividing the reference grayscale voltages. In addition, for the same reason, selection values with respect to some exemplary maximum luminance values (e.g., reference maximum luminance values) between 4 nits and 1200 nits may be pre-stored and used, and the other maximum luminance values may be generated by interpolating the selection values.

The pre-stored selection values may be set for each individual display device through Multi-Time Programming (MTP). That is, selection values may be set through repetitive measurements and stored in a display device, so that white color light with a desired luminance can be emitted with respect to the grayscale values GD.

FIGS. 10 to 13 are diagrams illustrating a power converter in accordance with an embodiment of the present disclosure.

Figure 10:
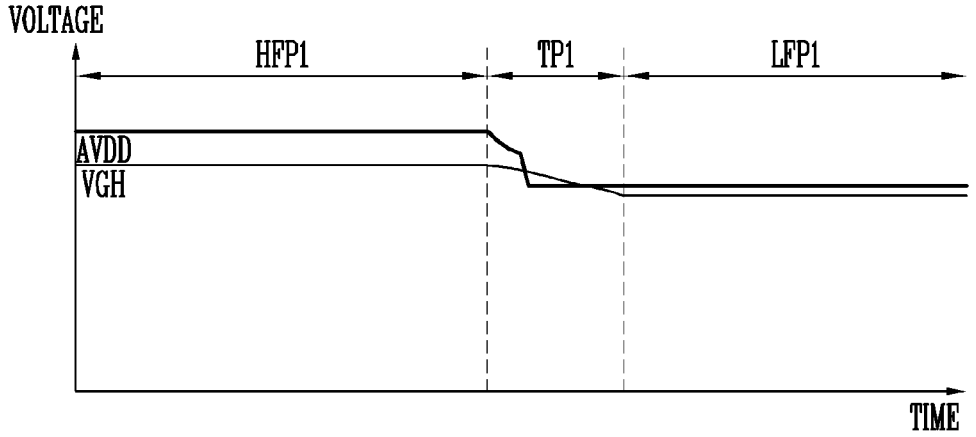
FIGS. 10 to 13 are diagrams illustrating a power converter in accordance with an embodiment of the present disclosure.

FIG. 10 is a diagram illustrating a voltage reversal phenomenon of the first voltage AVDD and the second voltage VGH when a first driving frequency period HFP1, a switching period TP1, and a second driving frequency period LFP1 sequentially progress in time.

For example, the second voltage VGH may be generated from the first voltage AVDD using a constant voltage circuit such as a low dropout circuit. Therefore, the second voltage VGH may be lower than the first voltage AVDD in the first driving frequency period HFP1 and the second driving frequency period LFP2.

However, in the switching period TP1 in which a driving frequency is lowered, a voltage reversal phenomenon in which the second voltage VGH becomes higher than the first voltage AVDD may occur. The voltage reversal phenomenon may occur for various reasons, for example, due to capacitance of elements that use the second voltage VGH. When the voltage reversal phenomenon occurs, voltages having an inappropriate level are provided to the pixels, and therefore, a luminance change may be observable by a user. To prevent the luminance change, an image frame displaying a black screen may be inserted in the switching period TP1. However, a screen flicker may be observable due to the black screen displayed in the switching period TP1.

Figure 11:
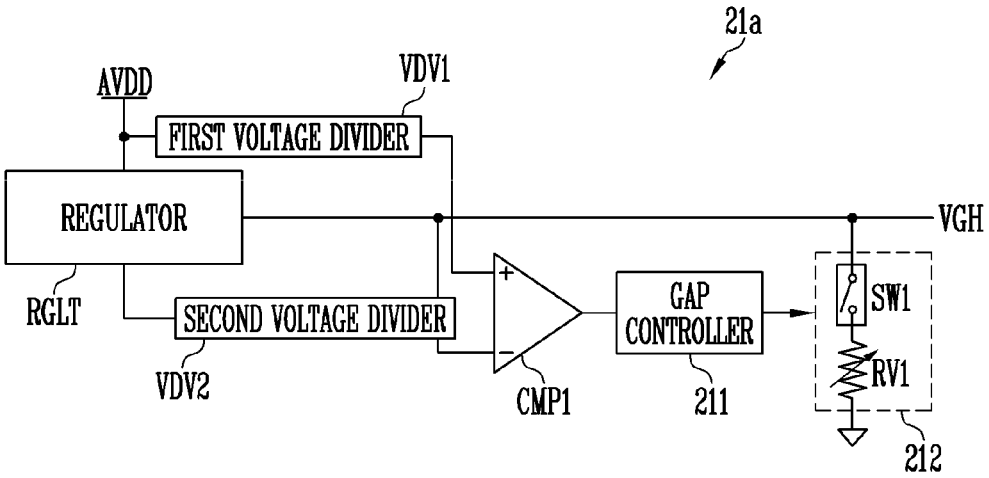

Referring to FIG. 11, a power converter 21*a* may include a regulator RGLT, a first voltage divider VDV1, a second voltage divider VDV2, a first comparator CMP1, a gap controller 211, and a first variable load 212.

A part for generating the first high voltage VREG in the power converter 21 may be implemented similarly to the power converter 21*a* as shown in FIG. 11, and therefore, a duplicate description will be omitted. In some embodiments, the part for generating the first high voltage VREG in the power converter 21 may be implemented with the regulator RGLT and the second voltage divider VDV2.

The regulator RGLT may convert the first voltage AVDD to the second voltage VGH. The regulator RGLT may receive a feedback voltage of the second voltage VGH via the second voltage divider VDV2 and controllably regulate the second voltage VGH based on a difference between the feedback voltage and a reference voltage (e.g., VGHref in FIG. 12). For example, the regulator RGLT may decrease the second voltage VGH when the feedback voltage is greater than the reference value of the second voltage VGH or may increase the second voltage VGH when the feedback voltage is smaller than the reference value of the second voltage VGH. Therefore, the regulator RGLT may regulate the second voltage VGH to have a constant level.

The first variable load 212 may be connected to an output terminal of the power converter 21*a*. For example, the first variable load 212 may include a first switch SW1 having one end connected to the output terminal of the power converter 21*a*. In addition, the first variable load 212 may include a first variable resistor RV1 connected to the other end of the first switch SW1. For example, the first variable resistor RV1 may be configured with transistors connected in parallel or be configured with transistors and resistors that are connected in parallel.

An input terminal of the first voltage divider VDV1 may be connected to a node to which the first voltage AVDD is applied, and an output terminal of the first voltage divider VDV1 may be connected to a first input terminal of the first comparator CMP1. In one embodiment, the first voltage divider VDV1 may include a plurality of resistors connected in series. Herein, the output voltage from the first voltage divider VDV1 is also referred to as a feedback voltage of the first voltage AVDD. According to one embodiment, the feedback voltage of the first voltage AVDD may be obtained by dividing the first voltage AVDD.

An input terminal of the second voltage divider VDV2 may be connected to the output terminal of the power converter 21*a* to sense an actual output value of the second voltage VGH and provide a feedback signal to the regulator RGLT on a first output terminal, and a second output terminal of the second voltage divider VDV2 may be connected to a second input terminal of the first comparator CMP1. In one embodiment, the second voltage divider VDV2 may include a plurality of resistors connected in series. The first output terminal and the second output terminal may be connected to each other according to specifications of the regulator RGLT and the first comparator CMP1. The second voltage divider VDV2 may provide the first output terminal connected to the regulator RGLT and/or the second output terminal connected to the first comparator CMP1 with the feedback voltage of the second voltage VGH. According to one embodiment, the feedback voltage of the second voltage VGH may be obtained by dividing the second voltage VGH.

When the first comparator CMP1 directly receives the first voltage AVDD and the second voltage VGH without dividing the first voltage AVDD and the second voltage VGH according to specifications of the first comparator CMP1, the power converter 21*a* may exclude the first voltage divider VDV1 and the second voltage divider VDV2.

The first comparator CMP1 may output a comparison result by comparing a difference between the feedback voltage of the first voltage AVDD and the feedback voltage of the second voltage VGH. For example, the first comparator CMP1 may be configured as an operational amplifier.

The gap controller 211 may control a magnitude of the first variable load 212 to maintain the difference between the first voltage AVDD and the second voltage VGH to be greater than or equal to a set gap. The gap controller 211 may be implemented in various forms and configurations, for example, an analog circuit, a logic device, a micro-processor, and a microcontroller. In some embodiments, the gap controller 211 may be integrated with another IC of the power converter 21*a*.

Figure 12:
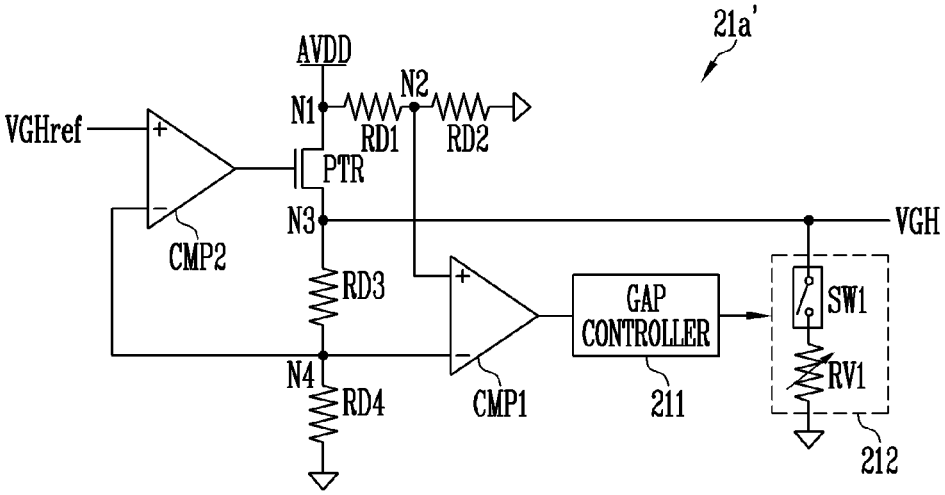

FIG. 12 illustrates an embodiment of a power converter 21*a*' including exemplary circuitry of the first voltage divider VDV1, the second voltage divider VDV2, and the regulator RGLT shown in FIG. 11.

The first voltage divider VDV1 may include a first resistor RD1 and a second resistor RD2. A first terminal of the first resistor RD1 may be connected to a first node N1 to which the first voltage AVDD is applied, and a second terminal of the first resistor RD1 may be connected to a second node N2. A first terminal of the second resistor RD2 may be connected to the second node N2, and a second terminal of the second resistor RD2 may be connected to a reference node. For example, the reference node may be a ground terminal. The feedback voltage of the first voltage AVDD may correspond to a voltage of the second node N2.

The second voltage divider VDV2 may include a third resistor RD3 and a fourth resistor RD4. A first terminal of the third resistor RD3 may be connected to a third node N3 that is an output terminal of the power converter 21*a*', and a second terminal of the third resistor RD3 may be connected to a fourth node N4. A first terminal of the fourth resistor RD4 may be connected to the fourth node N4, and a second terminal of the fourth resistor RD4 may be connected to a reference node. For example, the reference node may be a ground terminal. The feedback voltage of the second voltage VGH may correspond to a voltage of the fourth node N4. For convenience of description, it is assumed that a resistance ratio of the first resistor RD1 and the second resistor RD2 is equal to that of the third resistor RD3 and the fourth resistor RD4. However, it is understood that the resistance ratio of the first resistor RD1 and the second resistor RD2 may be different from that of the third resistor RD3 and the fourth resistor RD4 without deviating from the scope of the present disclosure.

The regulator RGLT may include a transistor PTR and a second comparator CMP2. A first electrode of the transistor PTR may be connected to the first node N1, a second electrode of the transistor PTR may be connected to the third node N3, and a gate electrode of the transistor PTR may be connected to an output terminal of the second comparator CMP2. A reference voltage VGHref may be applied to a first input terminal of the second comparator CMP2, a second input terminal of the second comparator CMP2 may be connected to the fourth node N4, and the output terminal of the second comparator CMP2 may be connected to the gate electrode of the transistor PTR.

When the voltage of the fourth node N4 is lower than the reference voltage VGHref, the second comparator CMP2 may increase a voltage of the third node N3 by turning on the transistor PTR. When the voltage of the fourth node N4 is higher than the reference voltage VGHref, the second comparator CMP2 may decrease the voltage of the third node N3 by turning off the transistor PTR. For example, the second comparator CMP2 may be configured as an operational amplifier.

Figure 13:
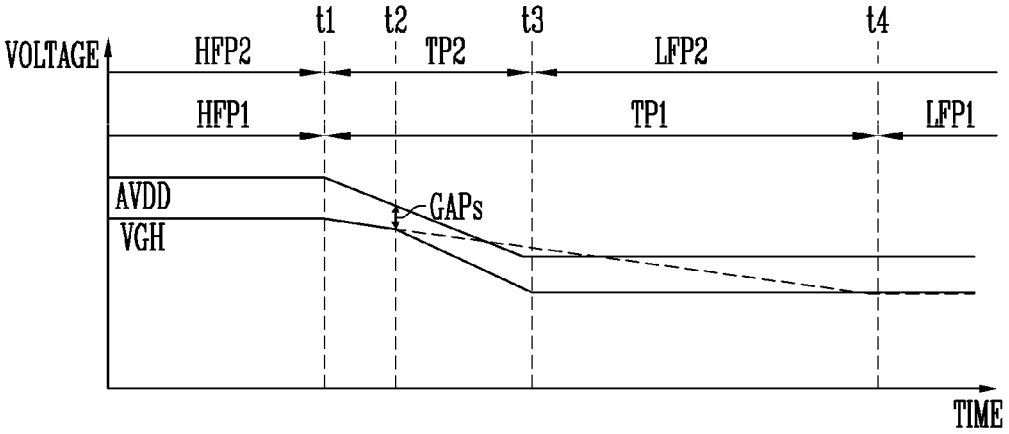

FIG. 13 illustrates an embodiment including a first driving frequency period HFP2, a switching period TP2, and a second driving frequency period LFP2 in comparison with the previous embodiment described with reference to FIG. 11 that includes the first driving frequency period HFP1, the switching period TP1, and the second driving frequency period HFP2.

Up to a first time t1, the pixels display image frames according to the first driving frequency.

At the first time t1, the first driving frequency period HFP2 ends, and the switching period TP2 starts. The switching period TP2 may be a transition period in which the driving frequency of the pixels is switched from the first driving frequency to the second driving frequency. The power provider 60 may decrease the first voltage AVDD from the value that is used in the first driving frequency period HFP2 to reduce power consumption.

The second voltage VGH may be decreased by turning off the transistor PTR. However, because of the capacitance of the elements using the second voltage VGH, a decrement of the second voltage VGH per unit time may be smaller than that of the first voltage AVDD per unit time. Therefore, the difference between the first voltage AVDD and the second voltage VGH may gradually decrease, and it may reach a gap GAPs at a second time t2.

The gap controller 211 may sense whether the difference between the first voltage AVDD and the second voltage VGH has reached the gap GAPs, based on the comparison result of the first comparator CMP1. To prevent the voltage reversal phenomenon, the gap controller 211 may control a magnitude of the first variable load 212 to maintain the difference between the first voltage AVDD and the second voltage VGH to be greater than or equal to the gap GAPs.

First, the gap controller 211 may turn on the first switch SW1 at the second time t2. That is, the first switch SW1 may be maintained in the turn-off state during the first driving frequency period HFP2, and may be turned on in the switching period TP2 or the second driving frequency period LFP2 when the difference between the first voltage AVDD and the second voltage VGH becomes equal to or less than the gap GAPs, in the present example, at the second time t2. In the present example, the first variable load 212 and the third node N3 may be connected to each other at the second time t2.

An initial value of the first variable load 212 may be differently set depending on the display device. The first variable load 212 may limit current flowing therethrough. For example, an optimum current to flow from the first node N1 to the third node N3 at the second time t2 may be preset and stored in a buffer or a memory. Therefore, a current flowing from the first node N1 to the third node N3 at the second time t2 may be sensed, and the initial value of the first variable load 212 may be determined to have a current corresponding to the difference between the optimum current and the sensed current flows through the first variable load 212. The resistance value of the first variable resistor RV1 may be determined according to the initial value of the first variable load 212.

Next, the gap controller 211 may again check the difference between the first voltage AVDD and the second voltage VGH based on the comparison result of the first comparator CMPL When the difference between the first voltage AVDD and the second voltage VGH is smaller than the gap GAPs, the gap controller 211 may increase the magnitude of the first variable load 212 from its initial value. For example, the gap controller 211 may increase the magnitude of the first variable load 212 by decreasing the resistance value of the first variable resistor RV1 from its initial value. Therefore, the current flowing through the first variable load 212 may be increased. Accordingly, a decrement of the second voltage VGH per unit time may be further increased. Referring to FIG. 13, the slope of the decrement of the second voltage VGH becomes stiffer (i.e., its decrement is further increased) compared to a projected slope (shown in a dashed line) that represents a case where no gap control is applied.

When the difference between the first voltage AVDD and the second voltage VGH is greater than or equal to the gap GAPs, the gap controller 211 may decrease the magnitude of the first variable load 212 from its initial value. For example, the gap controller 211 may decrease the magnitude of the first variable load 212 by increasing the resistance value of the first variable resistor RV1 from its initial value. Therefore, the current flowing through the first variable load 212 may be further decreased.

By repeating the above-described gap control process, the gap controller 211 may control the difference between the first voltage AVDD and the second voltage VGH in the switching period TP2 and/or the second driving frequency period LFP2 to correspond to the gap GAPs. Thus, the voltage reversal phenomenon can be prevented.

At a third time t3, when the first voltage AVDD is stably maintained since the decrement of the first voltage AVDD is converged to a threshold equal to or substantially close to zero, i.e., when the first voltage AVDD reaches a target value within an allowable tolerance, the first variable load 212 may be electrically separated from the output terminal of the power converter 21*a*'. For example, the first switch SW1 may be turned off.

In accordance with the present embodiment, the switching period TP2 can be shorter than the switching period TP1 while preventing the voltage reversal phenomenon. As shown in FIG. 13, the switching period TP2 may correspond to a period from the first time t1 to the third time t3, and the switching period TP1 may correspond to a period from the first time t1 to a fourth time t4 at which the second driving frequency period LFP1 starts.

In the above-described embodiment, a case where the driving frequency of the pixels is changed from the first driving frequency to the second driving frequency is described. When the driving frequency of the pixels is changed from the first driving frequency to the second driving frequency (i.e., when the driving frequency becomes slower), a voltage discharge period of the third node N3 may not be actively controlled through a switching operation of the transistor PTR, and is passively controlled to be in proportion to a period in which the transistor PTR is turned off. Hence, the above-describe embodiment would prevent the voltage reversal phenomenon from occurring during the transition of the driving frequency from a higher driving frequency to a slower driving frequency. Conversely, when the driving frequency of the pixels is changed from the second driving frequency to the first driving frequency (i.e., when the driving frequency becomes faster), a voltage increasing period of the third node N3 can be controlled through the switching operation of the transistor PTR, and the probability that the voltage reversal phenomenon would occur is low. Hence, the application of the present embodiment may be unnecessary during the transition of the driving frequency from a slower driving frequency to a faster driving frequency.

FIGS. 14 to 17 are diagrams illustrating a power provider in accordance with an embodiment of the present disclosure.

Figure 14:
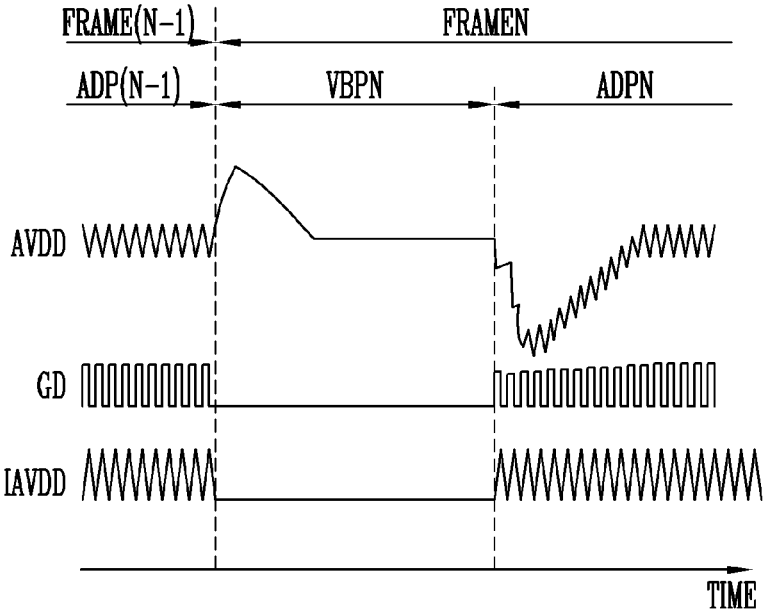
FIGS. 14 to 17 are diagrams illustrating a power provider in accordance with an embodiment of the present disclosure.

Referring to FIG. 14, voltage and current changes in two exemplary frame periods FRAME(N−1) and FRAMEN are illustrated.

Each of the frame periods FRAME(N−1) and FRAMEN may sequentially include a vertical blank period and an active data period. For example, an (N−1)th frame period may sequentially include a vertical blank period (not shown) and an active data period ADP(N−1), and an Nth frame period FRAMEN may sequentially include a vertical blank period VBPN and an active data period ADPN.

The vertical blank period VBPN may correspond to a transition period between the active data periods ADP(N−1) and ADPN. In the vertical blank period VBPN, the timing controller 10 may provide the data driver 20 with information regarding an image frame to be provided in the corresponding frame period FRAMEN including a clock training signal, dummy data, etc.

In the active data period ADPN, the timing controller 10 may provide the data driver 20 with the grayscale values GD of the pixels. The data driver 20 may convert the grayscale values GD to data voltages and provide the data voltages to the data lines DL1, DL2, . . . , and DLm.

When the vertical blank period VBPN starts, the data voltages are not supplied to the pixels, and therefore, a ripple increasing the first voltage AVDD may occur due to a sudden change of the load. Further, when the active data period ADPN starts, a ripple decreasing the first voltage AVDD may occur due to a sudden change of the load while the data voltages are being supplied to the pixels.

The stability of the first voltage AVDD and other related voltages may be affected due to the ripples. In addition, a voltage reversal phenomenon may occur due to the ripples. This may eventually result in a display failure problem, and therefore, it is desirable to minimize or prevent the ripples that may occur due to a sudden change of the load.

Figure 15:
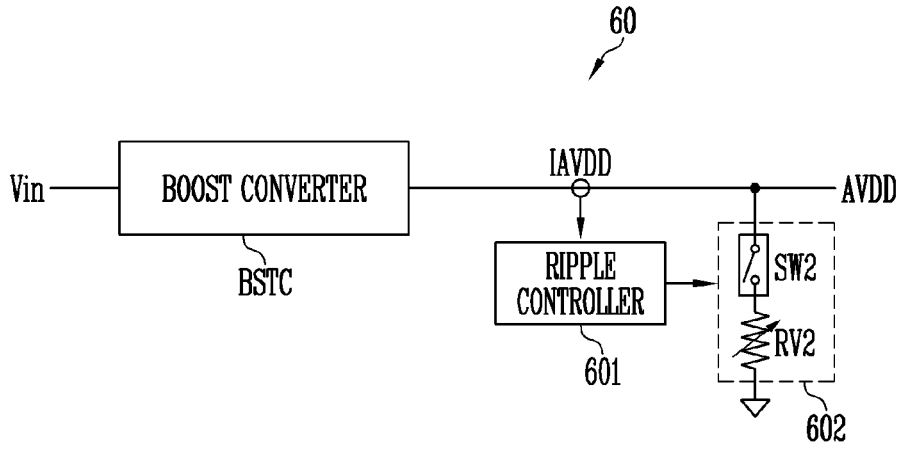

Referring to FIG. 15, the power provider 60 in accordance with an embodiment of the present disclosure may include a boost converter BSTC, a ripple controller 601, and a second variable load 602.

The power provider 60 may receive an external input voltage Vin and provide the first voltage AVDD to an output terminal by converting the external input voltage Vin.

The boost converter BSTC may have a configuration of a conventional boost converter. For example, the boost converter BSTC may output the first voltage AVDD by increasing the level of the external input voltage Vin.

The second variable load 602 may be connected to the output terminal of the power provider 60. The second variable load 602 may include a second switch SW2 and a second variable resistor RV2. A first terminal of the second switch SW2 may be connected to the output terminal of the power provider 60. The second variable resistor RV2 may be connected to a second terminal of the second switch SW2.

A first current IAVDD flows in the output terminal of the power provider 60. The ripple controller 601 may control a magnitude of the second variable load 602 by sensing the first current IVADD to maintain a decrement of the first current IAVDD per unit time to be smaller than or equal to a predetermined reference decrement. In other words, the magnitude of the second variable load 602 that is controlled by the ripple controller 601 may control an amount of change in current flowing through the second variable load 602.

Figure 16:
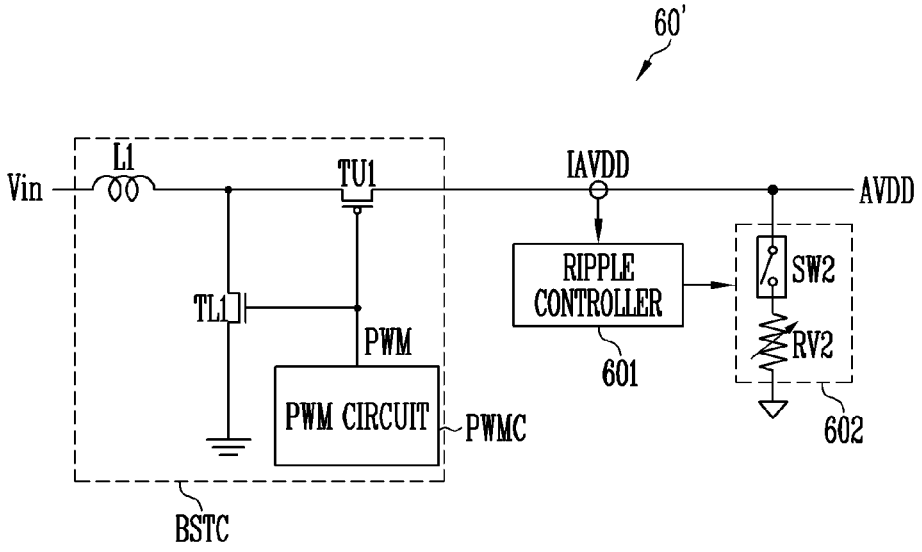

FIG. 16 illustrates a power converter 60' including the boost converter BSTC. According to one embodiment, the boost converter BSTC may include transistors TU1 and TL1, an inductor L1, and a pulse-width modulation (PWM) circuit PWMC.

The PWM circuit PWMC may generate a PWM signal PWM. The PWM signal PWM has an on/off duty cycle ratio and may alternately turn on/off the transistors TL1 and TU1.

First, when the transistor TL1 is turned on, and the transistor TU1 is turned off, energy is stored in the inductor L1 while current flowing through the inductor L1 is increasing. Next, when the transistor TL1 is turned off, and the transistor TU1 is turned on, the energy of the inductor L1 is discharged while the current flowing through the inductor L1 is decreasing. The first voltage AVDD that is amplified by adding current flowing from the inductor L1 to the external input voltage Vin is output. The first voltage AVDD may be further amplified as the duty cycle ratio of the PWM signal PWM increases.

Figure 17:
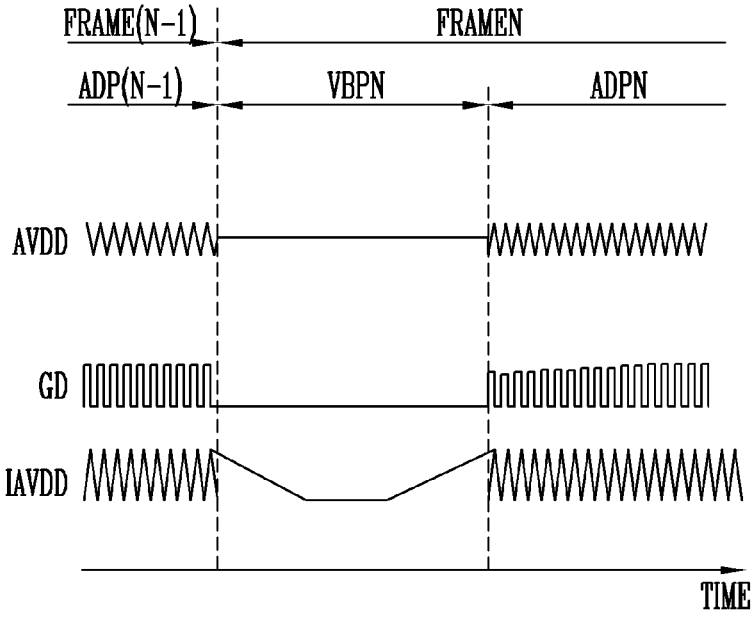

An operation of the power converter 60' in accordance with an embodiment of the present disclosure will be described with reference to FIG. 17.

In the active data periods ADP(N−1) and ADPN, the second switch SW2 may be in the turn-off state. In the vertical blank period VBPN or in a period switched from the active data period ADP(N−1) to the vertical blank period VBPN, the second switch SW2 may be turned on.

Therefore, the first current IAVDD has a new path of flowing in the second variable load 602, in addition to the output terminal of the power converter 60', and hence a decrement of the first current IAVDD per unit time may decrease. That is, the first current IAVDD when the second switch SW2 is turned on may decrease slower than the first current IAVDD when the second switch SW2 is turned on. An initial value of the second variable load 602 may be properly set depending on the display device. The magnitude of the second variable load 602 may refer to an amount of current flowing through the second variable load 602.

Next, the ripple controller 601 may again sense a decrement of the first current IAVDD. When the decrement of the first current IAVDD is greater than a reference decrement, the ripple controller 601 may increase the magnitude of the second variable load 602 from its initial value. For example, the ripple controller 601 may increase the magnitude of the second variable load 602 by decreasing the resistance value of the second variable resistor RV2 from its initial value.

When the decrement of the first current IAVDD is smaller than or equal to the reference decrement, the ripple controller 601 may decrease the magnitude of the second variable load 602 from its initial value. For example, the ripple controller 601 may decrease the magnitude of the second variable load 602 by increasing the resistance value of the second variable resistor RV2.

By repeating the above-described process, the ripple controller 601 may control the decrement of the first current IAVDD to correspond to the reference decrement (e.g., to be equal to the reference decrement). Accordingly, a ripple of the first voltage AVDD can be suppressed during the transition switching from the active data period ADP(N−1) to the vertical blank period VBPN.

The above-described embodiment may be similarly applied even in a transition period switching from the vertical blank period VBPN to the active data period ADPN.

For example, the ripple controller 601 may control an increment of the first current IAVDD to correspond to a predetermined reference increment by increasing/decreasing the resistance value of the second variable resistor RV2. Therefore, the ripple controller 601 may control the first current IAVDD to gently increase.

For example, the ripple controller 601 may sense an increment of the first current IAVDD. When the increment of the first current IAVDD is greater than the reference increment, the ripple controller 601 may decrease the magnitude of the second variable load 602. For example, the ripple controller 601 may decrease the magnitude of the second variable load 602 by increasing the resistance value of the second variable resistor RV2.

When the increment of the first current IAVDD is smaller than or equal to the reference increment, the ripple controller 601 may increase the magnitude of the second variable load 602. For example, the ripple controller 601 may increase the magnitude of the second variable load 602 by decreasing the resistance value of the second variable resistor RV2.

The present disclosure provides the display device and the driving method thereof in which a luminance deviation can be prevented from observable to a user while reducing power consumption.

Example embodiments have been disclosed herein, and although specific terms and expressions are employed, they are used and are to be interpreted in a generic and descriptive sense and not for purpose of limitation. In some instances, as would be apparent to one of ordinary skill in the art, features, characteristics, and/or elements described in connection with a particular embodiment may be used singly or in combination with features, characteristics, and/or elements described in connection with other embodiments unless otherwise explicitly indicated. Accordingly, it will be understood by those of skilled in the art that various changes in form and details may be made without departing from the spirit and scope of the present disclosure as set forth in the following claims.

What is claimed is:

1. A display device comprising:

pixels; and a power converter configured to receive a first voltage, convert the first voltage to a second voltage, and provide the second voltage to an output terminal to control the pixels, wherein the power converter includes:

a first variable load connected to the output terminal of the power converter;

a first comparator configured to provide a comparison result by comparing a difference between a first feedback voltage of the first voltage and a second feedback voltage of the second voltage; and a gap controller configured to control a magnitude of the first variable load to maintain a difference between the first voltage and the second voltage to be greater than or equal to a gap based on the comparison result received from the first comparator.

2. The display device of claim 1, wherein the first variable load includes a first switch having a first end connected to the output terminal of the power converter, wherein the first switch is in a turn-off state, in a first display mode in which the pixels display first image frames at a first driving frequency.

3. The display device of claim 2, wherein the first switch is turned on in a second display mode in which the pixels display second image frames at a second driving frequency that is lower than the first driving frequency or in a switching period in which a display mode of the display device is switched from the first display mode to the second display mode.

4. The display device of claim 3, wherein the first variable load further includes a first variable resistor connected to a second end of the first switch, wherein the gap controller decreases a resistance value of the first variable resistor, when the difference between the first voltage and the second voltage is smaller than the gap.

5. The display device of claim 4, wherein the gap controller increases the resistance value of the first variable resistor, when the difference between the first voltage and the second voltage is greater than or equal to the gap.

6. The display device of claim 5, wherein the power converter further includes:

a first resistor having a first terminal connected to a first node to which the first voltage is applied and a second terminal connected to a second node; and a second resistor having a first terminal connected to the second node, wherein the first feedback voltage of the first voltage corresponds to a voltage of the second node.

7. The display device of claim 6, wherein the power converter further includes:

a third resistor having a first terminal connected to a third node that is connected to the output terminal of the power converter and a second terminal connected to a fourth node; and a fourth resistor having a first terminal connected to the fourth node, wherein the second feedback voltage of the second voltage corresponds to a voltage of the fourth node.

8. The display device of claim 7, wherein the power converter further includes:

a transistor having a first electrode connected to the first node and a second electrode connected to the third node; and a second comparator having a first input terminal to which a reference voltage is applied, a second input terminal connected to the fourth node, and an output terminal connected to a gate electrode of the transistor.

9. The display device of claim 1, further comprising a power provider configured to receive an external input voltage, convert the external input voltage to the first voltage, and provide the first voltage to an output terminal, wherein the power provider includes:

a second variable load connected to the output terminal of the power provider; and a ripple controller configured to control a magnitude of the second variable load to maintain a decrement of first current per unit time to be smaller than or equal to a reference decrement, wherein the first current flows through the output terminal of the power provider.

10. The display device of claim 9, wherein the second variable load includes a second switch having a first end connected to the output terminal of the power provider, wherein the second switch is in the turn-off state, in an active data period in which grayscale values of the pixels are provided.

11. The display device of claim 10, wherein the second switch is turned on in a vertical blank period in which the grayscale values of the pixels are not provided or in a case in which the active data period is switched to the vertical blank period.

12. The display device of claim 11, wherein the second variable load further includes a second variable resistor connected to a second end of the second switch, wherein the ripple controller decreases a resistance value of the second variable resistor, when the decrement of the first current is greater than the reference decrement.

13. The display device of claim 12, wherein the ripple controller increases the resistance value of the second variable resistor, when the decrement of the first current is smaller than or equal to the reference decrement.

14. A display device comprising:

pixels; and a power provider configured to receive an external input voltage, convert the external input voltage to a first voltage, and provide the first voltage to an output terminal to control the pixels, wherein the power provider includes:

a variable load connected to the output terminal of the power provider; and a ripple controller configured to control a magnitude of the variable load to maintain a decrement of first current per unit time to be smaller than or equal to a reference decrement, wherein the first current flows through the output terminal of the power provider.

15. The display device of claim 14, wherein the variable load includes a switch having a first end connected to the output terminal of the power provider, wherein the switch is in a turn-off state, in an active data period in which grayscale values of the pixels are provided.

16. The display device of claim 15, wherein the switch is turned on in a vertical blank period in which the grayscale values of the pixels are not provided or in a case in which the active data period is switched to the vertical blank period.

17. The display device of claim 16, wherein the variable load further includes a variable resistor connected to a second end of the switch, wherein the ripple controller decreases a resistance value of the variable resistor, when the decrement of the first current is greater than the reference decrement.

18. The display device of claim 17, wherein the ripple controller increases the resistance value of the variable resistor, when the decrement of the first current is smaller than or equal to the reference decrement.

19. A method for driving a display device, the method comprising:

receiving, by a power converter of the display device, a first voltage, converting the first voltage to a second voltage, and providing the second voltage to an output terminal of the power converter;

displaying, by pixels of the display device, first image frames at a first driving frequency, using the second voltage;

displaying, by the pixels, second image frames at a second driving frequency that is lower than the first driving frequency, using the second voltage; and adjusting a magnitude of the second voltage to maintain a difference between the first voltage and the second voltage to be greater than or equal to a gap, in a period in which the pixels are driven at the second driving frequency or in a switching period in which a driving frequency of the pixels is switched from the first driving frequency to the second driving frequency.

20. The method of claim 19, wherein, in the adjusting of the magnitude of the second voltage, a magnitude of a first variable load connected to the output terminal of the power converter is adjusted.

* * * * *